US010787332B2

(12) United States Patent
Matsui et al.

(10) Patent No.: US 10,787,332 B2
(45) Date of Patent: Sep. 29, 2020

(54) SHEET CONVEYANCE APPARATUS AND IMAGE FORMING APPARATUS INCLUDING THE SAME

(71) Applicant: KONICA MINOLTA, INC., Chiyoda-ku, Tokyo (JP)

(72) Inventors: Naoki Matsui, Tokohashi (JP); Koji Soda, Toyokawa (JP); Yasuaki Tomoda, Toyohashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 61 days.

(21) Appl. No.: 15/920,703

(22) Filed: Mar. 14, 2018

(65) Prior Publication Data

US 2018/0282093 A1 Oct. 4, 2018

(30) Foreign Application Priority Data

Apr. 3, 2017 (JP) ..... 2017-073753

(51) Int. Cl.
*B65H 9/00* (2006.01)
*B65H 5/06* (2006.01)
(Continued)

(52) U.S. Cl.
CPC ..... *B65H 9/004* (2013.01); *B65H 5/062* (2013.01); *B65H 5/38* (2013.01); *B65H 9/06* (2013.01);
(Continued)

(58) Field of Classification Search
CPC . B65H 5/00; B65H 5/062; B65H 5/38; B65H 9/00; B65H 9/004; B65H 9/06;
(Continued)

(56) References Cited

U.S. PATENT DOCUMENTS 10,207,883 B2 * 2/2019 Inoue ..... B65H 5/26
2007/0273090 A1 * 11/2007 Kawaguchi ..... B65H 5/38 271/226

(Continued)

FOREIGN PATENT DOCUMENTS

CN 101493659 7/2009
CN 101846915 9/2010

(Continued)

OTHER PUBLICATIONS

Office Action issued in corresponding Chinese Patent Application No. 201810260929.6, dated Apr. 12, 2019 (16 pages).

*Primary Examiner* — Prasad V Gokhale
(74) *Attorney, Agent, or Firm* — Buchanan Ingersoll & Rooney PC

(57) ABSTRACT

A sheet conveyance apparatus that conveys a sheet along a curved path shorter than the sheet and corrects skew of the sheet, includes: a conveyance roller that sends the sheet into the curved path; a guide that guides the sheet along the curved path; and a gate that is hinders advance of the leading end, generates a moment about a normal of the sheet passing through the leading end, and allows advance of the leading end by being pushed away by the leading end, wherein the guide includes a projection projecting toward a movement space for the sheet on a surface facing the movement space, and the projection abuts a center portion of the sheet in a longitudinal direction and generates a moment about an axis parallel to an advance direction of a portion that has come into contact with the projection.

9 Claims, 9 Drawing Sheets

(51) Int. Cl.
*B65H 9/06* (2006.01)
*B65H 85/00* (2006.01)
*B65H 5/38* (2006.01)

(52) U.S. Cl.
CPC ..... *B65H 85/00* (2013.01); *B65H 2404/6111* (2013.01); *B65H 2404/722* (2013.01); *B65H 2404/725* (2013.01); *B65H 2404/7431* (2013.01); *B65H 2801/06* (2013.01)

(58) Field of Classification Search
CPC ..... B65H 85/00; B65H 2301/331; B65H 2301/333; B65H 2404/70; B65H 2404/722; B65H 2404/725; B65H 2404/7431
See application file for complete search history.

(56) References Cited

U.S. PATENT DOCUMENTS

2008/0251991 A1* 10/2008 Doyo ..... B65H 5/062 271/109
2013/0320616 A1* 12/2013 Nakagaki ..... B65H 7/02 271/227
2014/0291929 A1* 10/2014 Nguyen ..... B65H 1/266 271/274
2015/0069698 A1* 3/2015 Sugiura ..... B41J 13/0045 271/254
2016/0107856 A1* 4/2016 Tatsumi ..... B65H 9/006 271/3.2
2016/0291518 A1* 10/2016 Taniguchi ..... G03G 21/1633
2017/0057767 A1* 3/2017 Ishida ..... B65H 3/5223
2017/0115617 A1* 4/2017 Yamaguchi ..... B65H 5/26
2017/0176913 A1* 6/2017 Oya ..... G03G 21/1638
2018/0282092 A1* 10/2018 Kamikawa ..... B65H 1/04

FOREIGN PATENT DOCUMENTS

CN 105523404 4/2016
JP 04045041 A * 2/1992 ..... B65H 9/166
JP 2016-078977 A 5/2016
JP 2016-160077 A 9/2016

* cited by examiner

SHEET CONVEYANCE APPARATUS AND IMAGE FORMING APPARATUS INCLUDING THE SAME

The entire disclosure of Japanese patent Application No. 2017-073753, filed on Apr. 3, 2017, is incorporated herein by reference in its entirety.

BACKGROUND

Technological Field

The present invention relates to a sheet conveyance technique and particularly to skew correction.

Description of the Related Art

The sheet conveyance apparatus is mounted in a system for processing sheets such as printing paper, documents, etc., and conveys a sheet among processing sections in the system. This system includes, for example, an image forming apparatus such as a printer or a copying machine, a post-processing apparatus (finisher), or an automatic document feeder (ADF), and performs processes such as printing, imaging, sorting, binding, folding, etc. For the purpose of properly executing these processes, it is required for the sheet conveyance apparatus to feed a sheet to each element of the processing sections at a correct timing and in a correct posture.

One of functions of the sheet conveyance apparatus that keeps the sheet being conveyed in a correct posture is correcting the inclination of the leading end of the sheet with respect to a conveyance direction, that is, correction of the skew of the sheet. As conventional skew correction, for example, a roller registration method is known (for example, see JP 2016-078977 A). "Roller registration method" refers to skew correction that uses a registration roller (also referred to as a timing roller) whose main purpose is to temporarily stop the sheet and then send out the sheet at a proper timing. Specifically, while the leading end of a certain sheet is stopped by the registration roller, the sheet conveyance apparatus continues to feed the rear half portion of the same sheet toward the registration roller. As a result, a slack (loop) is formed in the sheet. Due to the elasticity of the sheet, a force to restore to the original flat shape is generated in this loop. This restoring force (the firmness) pushes the leading end of the sheet into a nip of the registration roller, and thus skew correction of the sheet is achieved.

In recent years, image forming apparatuses such as printers and copiers have been widely used in small offices/home offices (SOHO) and general households. Along with this, it is required that further miniaturization of image forming apparatuses is realized at low cost. In order to satisfy this requirement, it is necessary to further reduce the size of the sheet conveyance apparatus. Development of skew correction based on a gate registration method has been progressed as one of measures to meet this requirement for miniaturization (see, for example, JP 2016-160077 A). The "Gate registration method" refers skew correction utilizing a gate disposed in a sheet conveyance path. The "Gate" is a movable member with the ability to return to an original position, and when the gate is pushed in the conveyance direction with a force of a certain strength, the gate is retracted from the conveyance path, and when the force is weakened, the gate returns to the conveyance path. If the leading end of the sheet abuts only a part of the gate due to the skew, the sheet rotates about a normal passing through the leading end of the sheet by a reaction force from the gate before pushing the gate away. As a result, if the skew is corrected and the leading end abuts the entirety of the gate, the sheet can push the gate away and move forward. In this manner, in the skew correction by the gate registration method, it is not necessary to form a loop in the sheet. Therefore, it is not necessary to secure a space for a loop in the conveyance path, thus the conveyance path can be designed to be narrow, and miniaturization of the sheet conveyance apparatus can be achieved.

In order to further increase demand for image forming apparatuses such as printers and copiers for particularly SOHO and general households, it is also important to further improve the function by, for example, implementation of a duplex printing function. In a system having a duplex printing function, in general, the sheet conveyance apparatus performs skew correction in a path for reversing a sheet on one surface of which a printing process has been completed and returning the sheet to the printing process, that is, at a point (meeting point) where a reversing path has joined a feed path. Before this meeting point, the reversing path is often curved steeply in a U shape, and it can be said that curving of the reversing path is indispensable especially in miniaturizing the system. When a curved path exists before the point where skew correction is to be performed as described above, it is difficult to adopt the gate registration method for the skew correction. This is due to the following reason.

The sheet is fed into the curved path by a conveyance roller positioned at the starting point of the curved path and is pressed against the surface of a guide positioned outside the curve of the curved path by stress caused by the force of the conveyance roller, and is deformed along the surface. Meanwhile, in the gate registration method, the leading end of the sheet abuts a gate positioned at the terminal end of the curved path, and receives reaction force from the gate. Since this reaction force acts on the sheet in a direction to push back the sheet to the curved path, there is a region which is pressed against the surface of the guide by the stress due to this reaction force in the sheet. In this way, in the gate registration method, since the sheet is strongly pressed against the surface of the guide compared with the roller registration method, the sheet is likely to receive excessive frictional force from the surface. As a result, the sheet hardly rotates about a normal passing through the leading end, and thus the risk of insufficient skew correction is high.

SUMMARY

An object of the present invention is to solve the problem described above, and particularly, an object of the present invention to provide a sheet conveyance apparatus whose size can be further reduced by maintaining high reliability of skew correction by a gate registration method regardless of curvature of a sheet conveyance path.

To achieve the abovementioned object, according to an aspect of the present invention, a sheet conveyance apparatus that conveys a sheet along a curved path shorter than the sheet and corrects skew of the sheet at a terminal end of the curved path, reflecting one aspect of the present invention comprises: a conveyance roller that is disposed at a starting end of the curved path and sends the sheet into the curved path; a guide that is disposed outside a curve of the curved path and guides the sheet along the curved path; and a gate that is disposed at the terminal end of the curved path such that a leading end of the sheet abuts the gate, hinders advance of the leading end, generates, at the leading end, a moment about a normal of the sheet passing through the leading end, and allows advance of the leading end by being pushed away by the leading end, wherein the guide includes a projection projecting toward a movement space for the sheet on a surface facing the movement space, the projection being provided in a region further on an inside than both ends of the sheet in a width direction of the movement space, and wherein, when the leading end of the sheet abuts the gate, the projection abuts a center portion of the sheet in a longitudinal direction and generates a moment about an axis parallel to an advance direction of a portion that has come into contact with the projection at the center portion in accordance with the moment generated at the leading end by the leading end abutting the gate.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

[Appearance of Image Forming Apparatus]

Figure 1A:
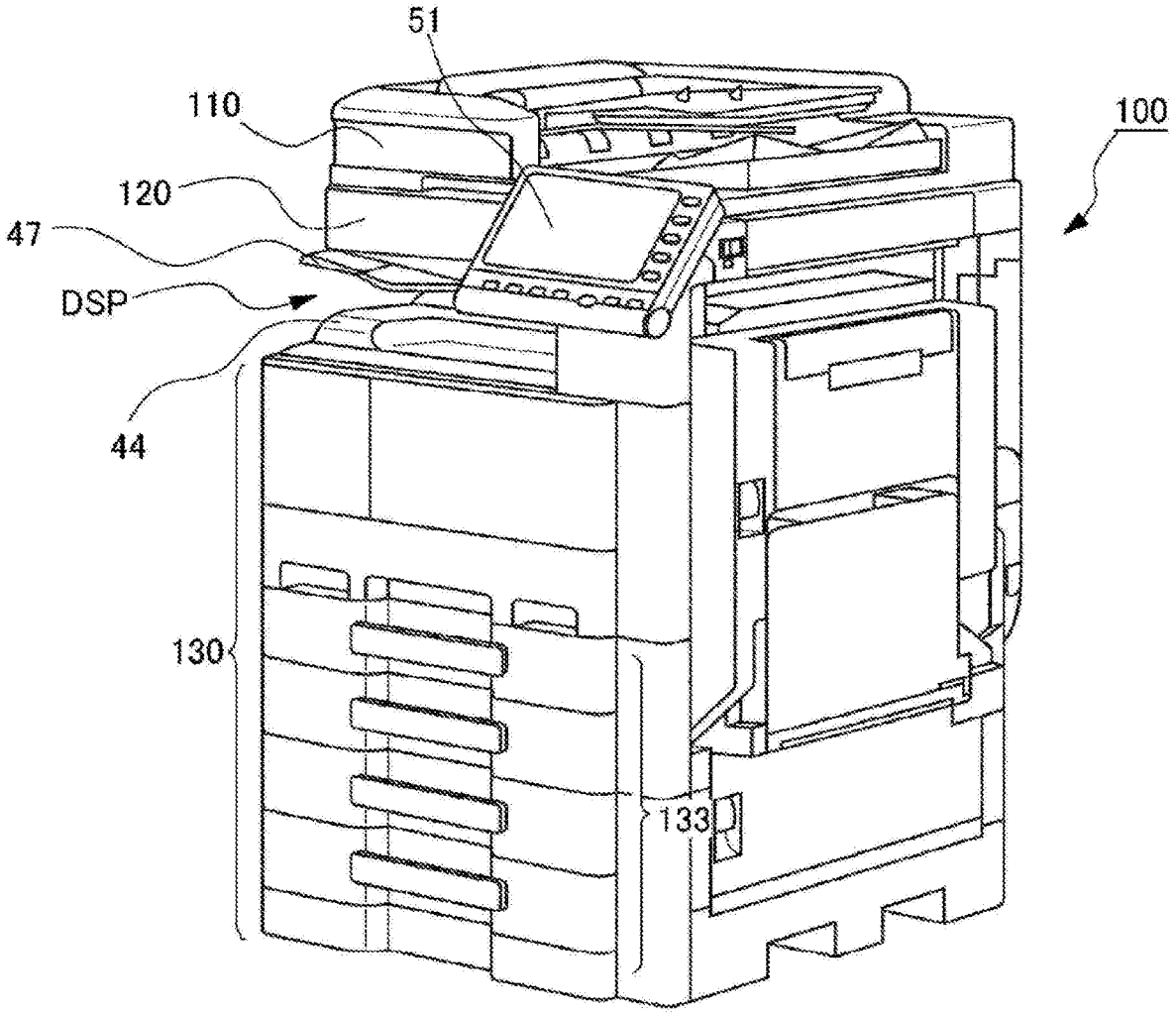
FIG. 1A is a perspective view of an image forming apparatus according to an embodiment of the present invention showing an appearance thereof.

FIG. 1A is a perspective view of an image forming apparatus according to an embodiment of the present invention showing an appearance thereof. This image forming apparatus 100 is a multi-function peripheral (MFP), and has functions of a scanner, a color copier, and a color printer. An automatic document feeder (ADF) 110 is mounted on the upper surface of the housing of the MFP 100 so as to be openable and closable. A scanner 120 is incorporated in an upper portion of the housing positioned right under the ADF 110, and a printer 130 is incorporated in a lower portion of the housing. A plurality of tiers of sheet feed cassettes 133 are removably attached to a bottom portion of the printer 130.

The MFP 100 is an in-body discharge type. That is, a gap DSP is provided between the scanner 120 and the printer 130, and a discharge tray 44 is disposed therein. A sheet discharge port (not visible in the drawing) is disposed at an end of the gap DSP, and a sheet is discharged therefrom to the discharge tray 44. A reverse tray 47 is disposed above the discharge tray 44. At the time of duplex printing, the sheet whose front surface has been subjected to printing is switched back on the reverse tray 47. That is, the sheet is once conveyed from a reverse port (not visible in the drawing) opened above the sheet discharge port to such a position as to stick out above the reverse tray 47, and thereafter, the conveyance direction thereof is reversed and the sheet is again retracted into the reverse port. An operation panel 51 is attached to a front portion of the housing positioned beside the gap DSP. A touch panel is embedded in the front surface of the operation panel 51 and surrounded by various mechanical push buttons. The touch panel displays a graphics user interface (GUI) screen such as an operation screen and an input screen for various information, and receives a user's input operation through a gadget such as an icon, a virtual button, a menu, a tool bar or the like included in the screen.

[Structure of Printer]

Figure 1B:
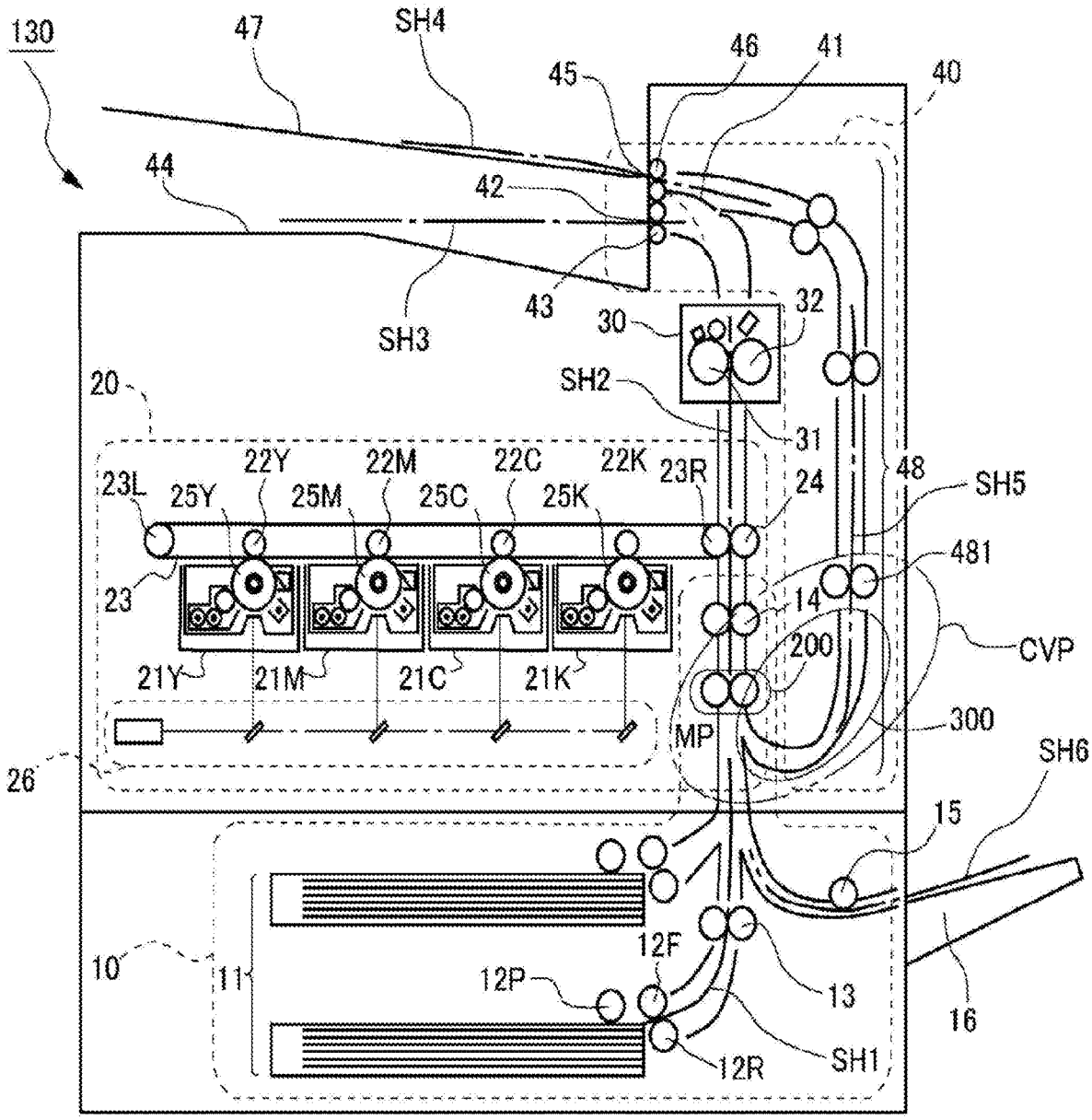
FIG. 1B is a front view of this apparatus schematically showing an internal structure of a printer incorporated in this apparatus.

FIG. 1B is a front view of the printer 130 schematically showing an internal structure thereof. In this figure, the elements of the printer 130 are illustrated as though the elements are seen through the front side of the housing. The printer 130 is a color printer of an electrophotographic system and includes a feeding unit 10, an image forming section 20, a fixing unit 30, and a sheet discharging unit 40. The feeding unit 10 and the sheet discharging unit 40 are part of a sheet conveyance apparatus incorporated in the MFP 100, and convey a sheet in the housing of the printer 130. The image forming section 20 and the fixing unit 30 cooperate to function as an image forming part, and draw an image with toner on a sheet conveyed by the feeding unit 10 and the sheet discharging unit 40.

The feeding unit 10 feeds one sheet at a time from a sheet feed cassette 11 or a manual feed tray 16 to the image forming section 20 by using a plurality of conveyance rollers 12P, 12F, 12R, 13, 14, and 15. Examples of a material of sheets that can be accommodated in the sheet feed cassette 11 and the manual feed tray 16 include paper and resin, and examples of the type of paper include plain paper, high quality paper, color paper, and coated paper. Examples of the size of the sheet include A3 to A7, B4 to B7, business card, bookmark, ticket, postcard, envelope, and photograph (L size). The posture of the sheet can be set both in a vertical position and in a horizontal position.

The image forming section 20 forms a toner image on a sheet SH2 fed from the feeding unit 10. Specifically, four image forming units 21Y, 21M, 21C, and 21K first respectively charge the surfaces of photosensitive drums 25Y, 25M, 25C, and 25K, and the surfaces of the photosensitive drums 25Y to 25K are exposed in patterns based on image data by using laser light irradiated from an optical scanning unit 26. As a result, electrostatic latent images are formed on the surfaces of the photosensitive drums 25Y to 25K. The image forming units 21Y to 21K then respectively develop the electrostatic latent images with toner of different colors of yellow (Y), magenta (M), cyan (C), and black (K). The four color toner images are sequentially transferred onto the same position on the surface of an intermediate transfer belt 23 from the surfaces of the photosensitive drums 25Y to 25K by an electric field between primary transfer rollers 22Y, 22M, 22C and 22K and the photosensitive drums 25Y to 25K. Thus, one color toner image is formed at that position. When this color toner image passes through a nip between a driving roller 23R for the intermediate transfer belt 23 and a secondary transfer roller 24, the color toner image is further transferred, by an electric field between the rollers 23R and 24, onto the surface of the sheet SH2 that is passing through the nip at the same time. The sheet SH2 is further sent from the secondary transfer roller 24 to the fixing unit 30.

The fixing unit 30 thermally fixes the toner image on the sheet SH2 fed from the image forming section 20. Specifically, when the sheet SH2 passes through a nip between a fixing roller 31 and a pressure roller 32, the fixing roller 31 applies heat of a built-in heater to the surface of the sheet SH2, and the pressure roller 32 presses the heated portion of the sheet SH2 against the fixing roller 31 by applying pressure. The toner image is fixed on the surface of the sheet SH2 by the heat from the fixing roller 31 and the pressure from the pressure roller 32. Thereafter, the fixing unit 30 sends out the sheet SH2 from an upper portion thereof.

The sheet discharging unit 40 firstly assigns a sheet SH3 or SH4 sent out from the fixing unit 30 to either a sheet discharge roller 43 or a reverse roller 46 by a switching claw 41. The sheet discharge roller 43 sends out a sheet SH3 that has moved along the switching claw 41 through the discharge port 42 to the discharge tray 44. The reverse roller 46 first places a sheet SH4 that has moved along the switching claw 41 on the reverse tray 47 through a reverse port 45 by normal rotation. Just before the trailing end of the sheet SH4 passes, the reverse roller 46 reversely rotates to pull the sheet SH4 from the reverse tray 47 into the reverse port 45, that is, switches back the sheet SH4 to send the sheet SH4 to a circulation path 48. In the circulation path 48, a plurality of conveyance rollers return a sheet SH5 delivered by the reverse roller 46 to a conveyance path in the feeding unit 10 in a reversed posture. Thereafter, the feeding unit 10 sends the sheet SH5 to the image forming section 20 again, and the image forming section 20 forms a toner image on the back surface of the sheet SH5. The fixing unit 30 heats the sheet SH5 again, and the sheet discharging unit 40 discharges the sheet SH5 to the discharge tray 44 this time.

[Structure of Sheet Conveyance Apparatus]

In addition to the conveyance rollers 12P, 12F, 12R, 13, 14, and 15 of the feeding unit 10, conveyance rollers 43 and 46 of the sheet discharging unit 40, and the circulation path 48, the sheet conveyance apparatus incorporated in the MFP 100 uses the rollers 23R and 24 of the image forming section 20 and the rollers 31 and 32 of the fixing unit 30 for conveying the sheet. The sheet conveyance apparatus in particular includes a timing roller 14, a skew correction portion 200, and a curved path 300.

—Timing Roller—

The timing roller 14 passes the sheet through the nip between the intermediate transfer belt 23 and the secondary transfer roller 24 at a proper timing. More specifically, the timing roller 14 first stops each time a sheet arrives from the upstream side of the conveyance path. As a result, the leading end of the sheet SH1, SH5, or SH6, which have been moved from any one of the sheet feed cassettes 11, the manual feed tray 16, and the circulation path 48, also temporarily stops at the nip formed by the timing roller 14. Thereafter, the timing roller 14 starts to rotate in response to a command from a main control unit, and sends the stopped sheet to the image forming section 20. The main control unit is an electronic circuit (not shown) incorporated in the printer 130, and by causing a microprocessor such as a central processing unit (CPU) or a micro-processing unit (MPU) to execute firmware, various commands are given to the elements 10 to 40 of the printer 130. The main control unit particularly determines the timing of starting the rotation of the timing roller 14 on the basis of a timing at which that the toner image formed on the surface of the intermediate transfer belt 23 by the image forming units 21Y to 21K passes through the nip between the intermediate transfer belt 23 and the secondary transfer roller 24. As a result, the sheet SH2 delivered from the timing roller 14 passes through the nip between the intermediate transfer belt 23 and the secondary transfer roller 24 simultaneously with the toner image. As a result, the toner image is correctly transferred onto the sheet SH2.

—Skew Correction Portion—

As shown in FIG. 1B, three sheet feed paths from the sheet feed cassette 11 and the manual feed tray 16 are merged into one path downstream of a vertical feed roller 13, and the path further joins the circulation path 48 at a meeting point MP that is further downstream. A skew correction portion 200 is disposed between the meeting point MP and the timing roller 14. The skew correction portion 200 performs skew correction by the gate registration method on the sheet SH1, SH5, or SH6 that has moved from any one of the sheet feed cassettes 11, the circulation path 48, and the manual feed tray 16.

Figure 2A:
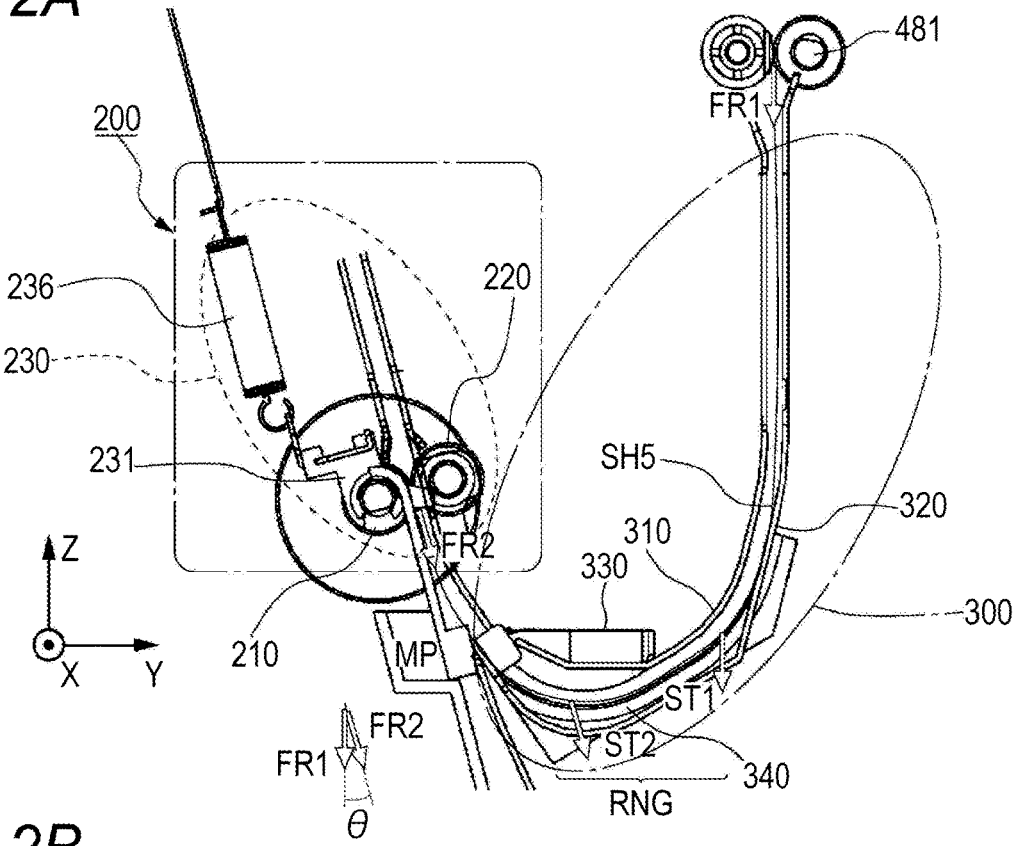
FIG. 2A is an enlarged front view of a skew correction portion and a curved path circled by an ellipse in FIG. 1B.
Figure 2B:
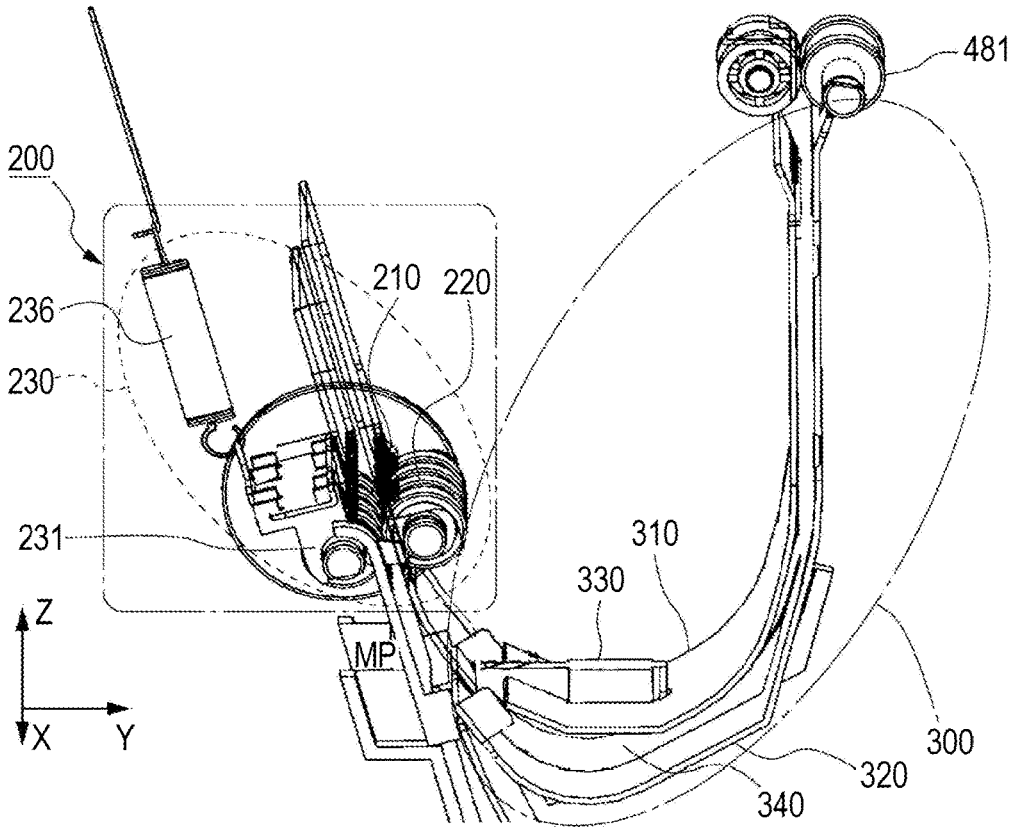
FIG. 2B is a perspective view of the skew correction portion and the curved path from an upper front viewpoint.
Figure 3A:
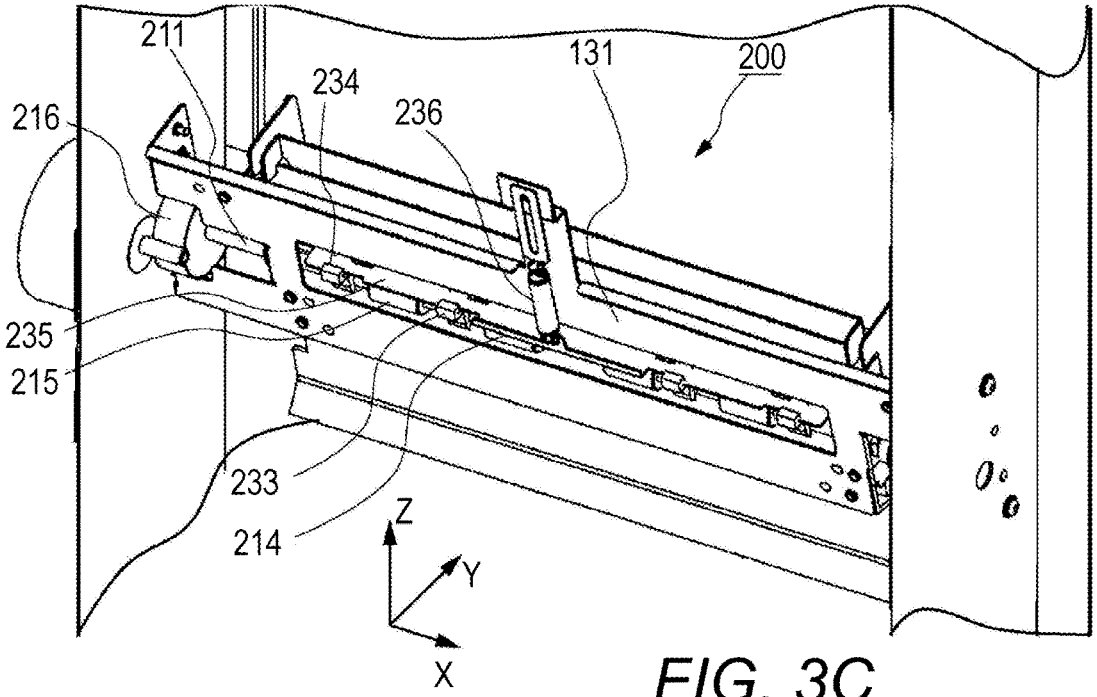
FIG. 3A is an enlarged side view from a viewpoint obliquely above the skew correction portion shown in FIGS. 2A and 2B.
Figure 3C:
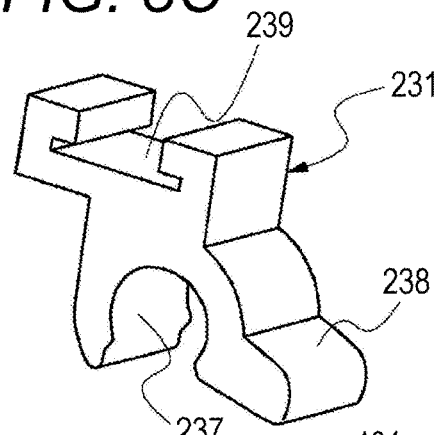
FIG. 3C is an enlarged perspective view of one of swing members included in the skew correction portion.
Figure 3B:
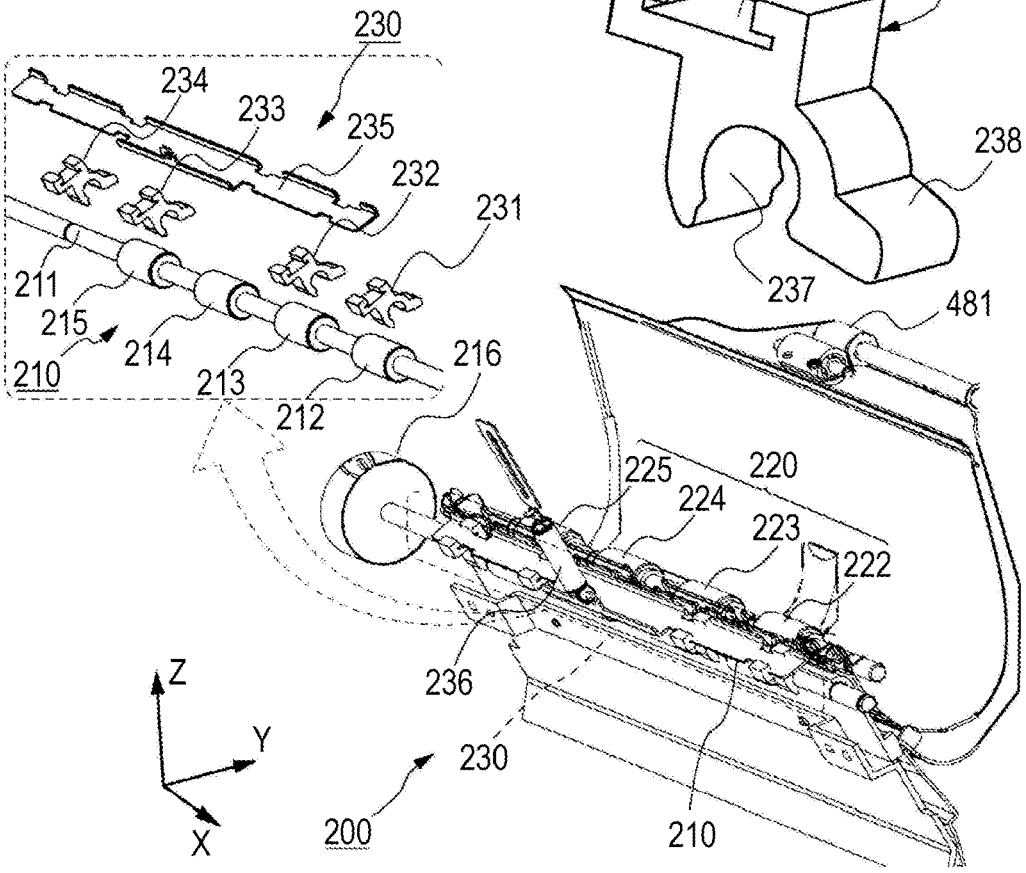
FIG. 3B is an exploded view of the skew correction portion.

FIG. 2A is an enlarged front view of the skew correction portion 200 and the curved path 300 circled by an ellipse CVP in FIG. 1B, and FIG. 2B is a perspective view of the skew correction portion 200 and the curved path 300 from an upper front viewpoint; FIG. 3A is an enlarged side view of the skew correction portion 200 from an obliquely upper viewpoint, and FIG. 3B is an exploded view of the skew correction portion 200. In these figures, members unnecessary for description of the skew correction portion 200 are illustrated as though the members are removed or transparent. As shown in these figures, the skew correction portion 200 includes a driving roller 210, a driven roller 220, and a gate 230.

The driving roller 210 includes a shaft 211, sleeves 212, 213, 214, and 215, and a gear 216. As shown in FIG. 3A, both ends of the shaft 211 are supported by a chassis 131 of the printer 130 so as to be rotatable about the axis thereof. As shown in FIG. 3B, the sleeves 212 to 215 are cylindrical members of the same size and are made of a soft resin and fixed coaxially to and at equal intervals along the shaft 211. The gear 216 is coaxially fixed to one end of the shaft 211, receives rotational force from an external motor (not shown), and rotates the shaft 211 about the axis thereof. Along with this rotation, the sleeves 212 to 215 also rotate.

The driven roller 220 includes four cylindrical members 222, 223, 224, and 225 as shown in FIGS. 2B and 3B. All of these cylindrical members are made of a soft resin and have the same size as the sleeves 212 and 215 of the driving roller 210, and both ends of each cylindrical member are supported so as to be rotatable about the central axis in a coaxially aligned state. The direction of a common axis (X-axis direction in FIGS. 2A, 2B, and 3A to 3C) of the cylindrical members 222 to 225 are parallel to the shaft 211 of the driving roller 210, and nips are formed by bringing the outer peripheral surfaces of the cylindrical members 222 to 225 to the sleeves 212 to 215 in one-to-one correspondence. The sheet that has passed through the meeting point MP of a sheet feed path and the circulation path 48 enters these nips. When the sleeves 212 to 215 rotate along with the rotation of the shaft 211, the cylindrical members 222 to 225 are driven to rotate, and the sheet entering the nips therebetween is sent to the timing roller 14.

As shown in FIGS. 2B and 3B, the gate 230 includes four swing members 231, 232, 233, and 234, a connection plate 235, and an elastic member 236. FIG. 3C is an enlarged perspective view of one of the swing member 231 among the swing members 231 to 234. Each of the swing members 231 to 234 is a molded resin product of the same size, and includes a hook portion 237, a claw portion 238, and a holding portion 239. The hook portion 237 is a C-shaped portion, and the inner peripheral surface thereof is in contact with the outer peripheral surface of the shaft 211. As a result, the swing members 231 to 234 are coaxially supported by the shaft 211 so as to be slidably rotatable about the shaft 211. Among the sleeves 212 to 215, the sleeves 212 and 215 are disposed on the outside and the sleeves 213 and 214 are disposed on the inside in the axial direction of the shaft 211. The swing members 231 to 234 are particularly arranged such that one swing member is disposed further on the outside than each of the sleeves 212 and 215 in the axial direction of the shaft 211, and one swing member is disposed at each position between the sleeves 212 and 213 and between the sleeves 214 and 215. The claw portion 238 is a claw-like portion projecting in the radial direction from one end of the hook portion 237 in the circumferential direction. The holding portion 239 is positioned on the side opposite to the claw portion 238 on the outer peripheral surface of the hook portion 237, and is a flat plane portion spreading along the tangential plane of the outer peripheral surface. The connection plate 235 is an elongated rectangular metal plate or a rigid resin plate, is disposed in parallel to the shaft 211, and is held by the holding portion 239 of the swing members 231 to 234. As a result, when the swing members 231 to 234 rotate about the shaft 211, the swing members 231 to 234 always slide together. The elastic member 236 is, for example, a coil spring, one end of which is connected to the chassis 131 of the printer 130, and the other end of which is connected to the center of the connection plate 235 in the longitudinal direction. Therefore, when the swing members 231 to 234 rotate about the shaft 211 altogether, the elastic member 236 expands and contracts in accordance with the displacement of the connection plate 235. At this time, the restoring force of the elastic member 236 acts on the swing members 231 to 234 in such a direction as to keep the angle about the shaft 211 constant. At this constant angle, as shown in FIGS. 2A and 2B, the claw portions 238 of the swing members 231 to 234 are positioned upstream of the nip between the driving roller 210 and the driven roller 220, and the leading end of the sheet that has passed the meeting point MP of the sheet feed path and the circulation path 48 abuts the gate 230.

Figure 4:
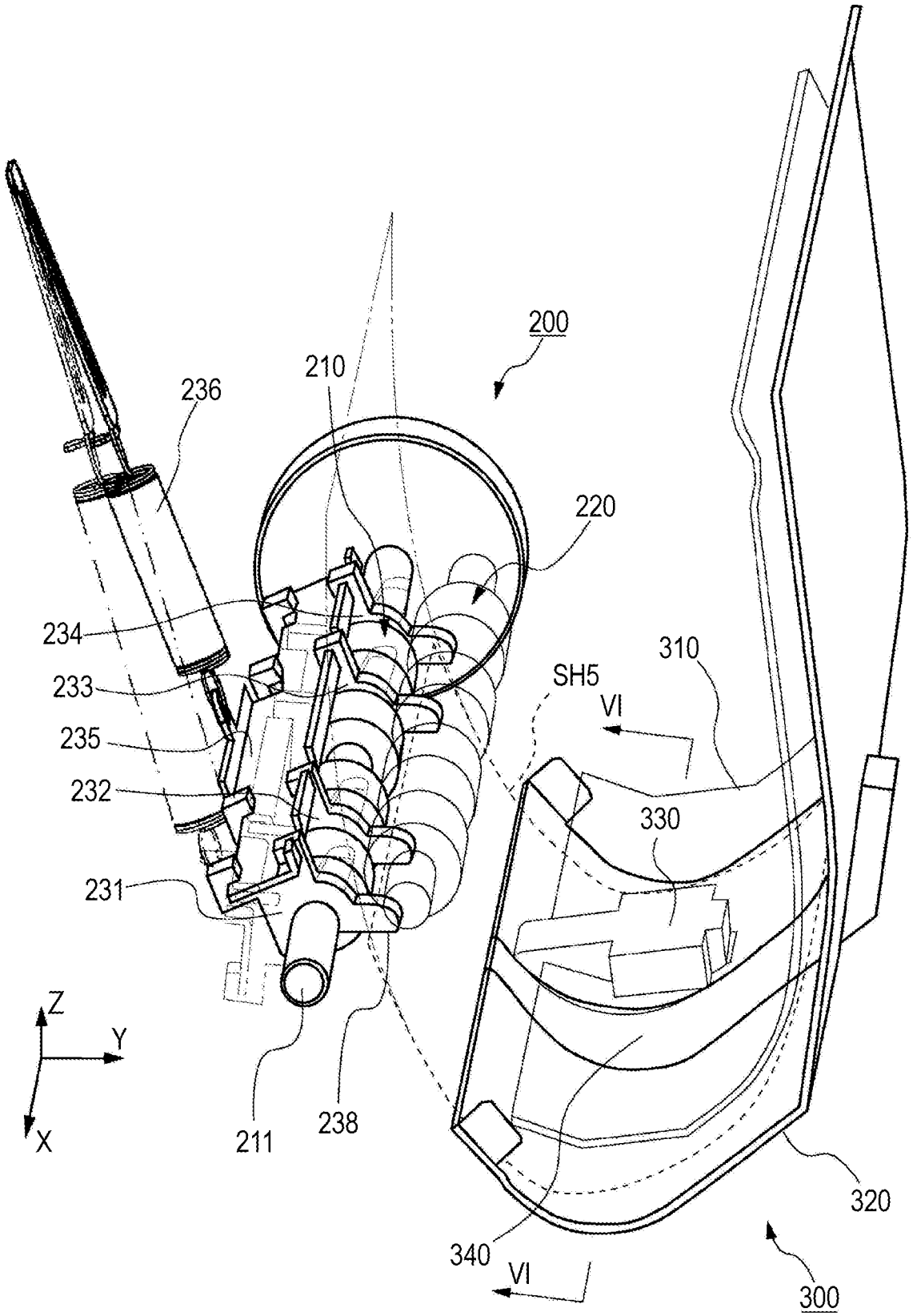
FIG. 4 is a perspective view of the skew correction portion shown in FIGS. 2A and 2B showing movement of a gate when the leading end of a sheet abuts the gate.

FIG. 4 is a perspective view of the gate 230 showing the movement of the gate 230 when the leading end of the sheet abuts the gate 230. As shown in FIG. 1B, the sheet SH1 passing through the meeting point MP from the sheet feed path is pushed by the force of the sheet feed roller 12F or the vertical feed roller 13 which feeds the rear half portion thereof, the sheet SH5 passing through the meeting point MP from the circulation path 48 is pushed by the force of a conveyance roller 481 for sending out the rear half portion thereof. Thus, the leading end of the sheet is caused to advance toward the nip between the driving roller 210 and the driven roller 220. By causing the claw portions 238 to abut the leading portion, the swing members 231 to 234 temporarily prevent progress of the leading end. However, since the force of the conveyance rollers 12F, 13, and 481 received by the claw portions 238 from the leading end of the sheet is stronger than the restoring force received by the connection plate 235 from the elastic member 236, the swing members 231 to 234 are rotated about the shaft 211, in such a direction that the claw portions 238 are pushed away by the leading end of the sheet. In this way, the swing members 231 to 234 allow the leading end of the sheet to enter the nip between the driving roller 210 and the driven roller 220. The driving roller 210 sends this sheet to the timing roller 14. When the driving roller 210 finishes feeding the trailing end of this sheet, the claw portions 238 are released from the sheet, and thus the swing members 231 to 234 are returned to the original angle by the restoring force of the elastic member 236, and the claw portions 238 are moved back to the positions upstream of the nip.

As shown in FIG. 1B, the curvature of the sheet conveyance path is small from the conveyance rollers 12F and 13 positioned at the most downstream portion of the sheet feed path to the nip between the driving roller 210 and the driven roller 220 compared with the curved path 300 positioned at the most downstream portion of the circulation path 48. In particular, stress generated in the sheet due to reaction force that the claw portions 238 of the swing members 231 to 234 apply to the leading end of the sheet acts on the entire sheet, and a component that presses the sheet to the surface of a guide disposed outside the curve of the curved path is small. Therefore, frictional force that the sheet receives from the surface of the guide due to this component is weak. As a result, the skew correction portion 200 can reliably achieve skew correction on the sheet that has moved from the sheet feed path. Actually, when skew occurs in the sheet, the leading end of the sheet abuts one of the claw portions 238 of the swing members 231 to 234 before the other claw portions 238. In this case, the sheet rotates around a normal passing through the leading end thereof by the reaction force from the claw portion 238 before pushing away the claw portion 238 that the leading end abuts. Since the frictional force from the guide due to this reaction force is weak, the sheet smoothly rotates to a position where the leading end abuts all the claw portions 238 of the swing members 231 to 234. In this way, skew is reliably removed from the sheet.

—Curved Path—

As shown in FIG. 1B, the curved path 300 is the most downstream portion of the circulation path 48, and the terminal end thereof is positioned at the meeting point MP with the sheet feed path. As shown in FIG. 2A, the curved path 300 is shorter than the sheet SH5, and there is no other conveyance roller between the conveyance roller 481 positioned at the starting end and the driving roller 210 of the skew correction portion 200 positioned at the terminal end. An inner guide 310 is disposed inside the curve of the curved path 300, and an outer guide 320 is disposed outside of the curve. Each of the guides 310 and 320 is a plate-like member made of a metal or a hard resin whose plate surface is substantially curved in a J-shape, partitions the movement space for the sheet SH5 spreading along the curved path 300 from the outside, and guides the sheet SH5 along the curved path 300.

The curved path 300 is more curved than the conveyance path from the sheet feed path to the skew correction portion 200. Specifically, force FR1 applied by the conveyance roller 481 positioned at the starting end of the curved path 300 to the sheet SH5 and reaction force FR2 applied to the leading end of the same sheet SH5 by the claw portions 238 of the swing members 231 to 234 only form an angle θ smaller than 90°. In this case, stress generated inside the sheet SH5 due to either of the forces FR1 and FR2 not only includes components ST1 and ST2 for pressing the sheet SH5 against the surface of the outer guide 320, but also both of the components ST1 and ST2 are remarkably large in the same range RNG of the curved path 300. Therefore, frictional force that the sheet SH5 receives from the outer guide 320 is generally stronger than frictional force that the sheet SH1 sent from the sheet feed path to the skew correction portion 200 receives from the guide.

Although the sheet SH5 passing through the curved path 300 receives the strong frictional force from the outer guide 320, the skew correction portion 200 can reliably achieves skew correction on this sheet SH5. This is because the guides 310 and 320 respectively include projection members 330 and 340 in curved portions thereof as shown in FIGS. 2A and 2B.

Figure 5A:
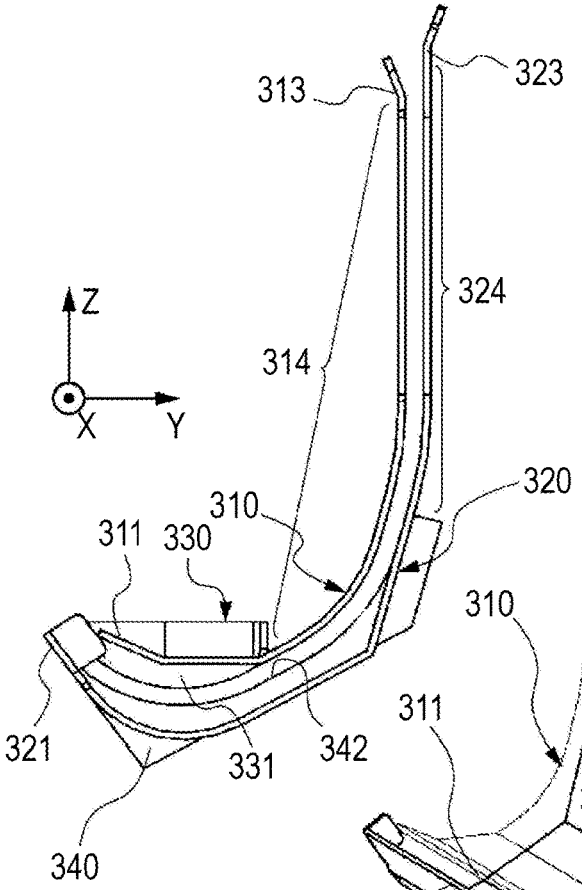
FIGS. 5A and 5B are respectively a front view and a perspective view of the guide shown in FIGS. 2A and 2B.
Figure 5B:
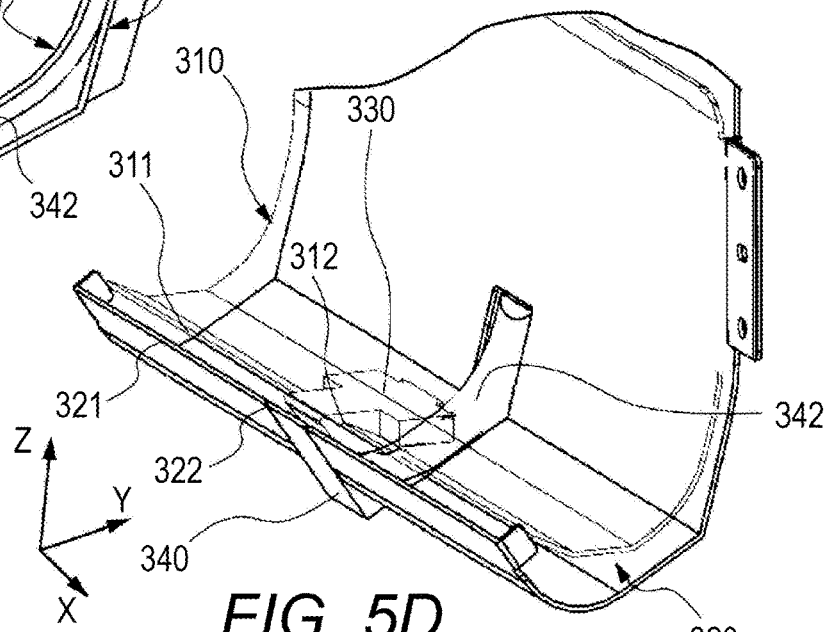

FIGS. 5A and 5B are respectively a front view and a perspective view of the guides 310 and 320. In FIG. 5B, the inner guide 310 is illustrated as if the inner guide 310 is transparent, making the structure of the outer guide 320 easy to see. Downstream ends 311 and 321 of the guides 310 and 320 in the conveyance direction along the curved path 300 respectively include slits 312 and 322 of shapes elongated in the conveyance direction at a center portion in the width direction. The slit 322 of the outer guide 320 is longer than the slit 312 of the inner guide 310 and extends over almost the entire curved portion of the outer guide 320 as shown in FIG. 5A. Further, upstream ends 313 and 323 of the guides 310 and 320 in the conveyance direction are parallel to the width direction, and ranges 314 and 324 from the upstream ends 313 and 323 to the slits 312 and 322 include smooth curved surfaces. Projection members 330 and 340 are respectively fitted in the slits 312 and 322, and are opposed to each other with a movement space for the sheet SH5 interposed therebetween.

The projection member 330 fitted in the inner guide 310 is, for example, a plate made of a soft resin and has a thickness equal to the width of the slit 312 of the inner guide 310. As shown in FIG. 5A, about a half 331 of the plate surface of the projection member 330 projects to the movement space for the sheet SH5 than the inner guide 310. A portion 332 projecting to the movement space among the side surface of the projection member 330 spreading along the circumference of the plate surface has a band shape that is smoothly curved along the conveyance direction, and forms a smooth J-shaped curved surface together with the range 314 from the upstream end 313 to the slit 312 in the surface of the inner guide 310. Since the surface facing the movement space for the sheet SH5 is smooth as described above, both the inner guide 310 and the projection member 330 hardly scratch the surface of the sheet SH5 due to friction.

Figure 5C:
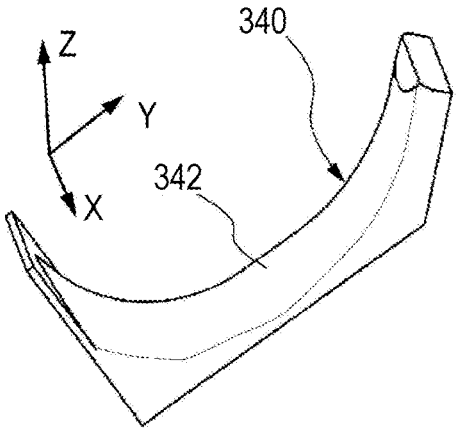
FIG. 5C is a perspective view of a projection member to be fitted in the guide.
Figure 5D:
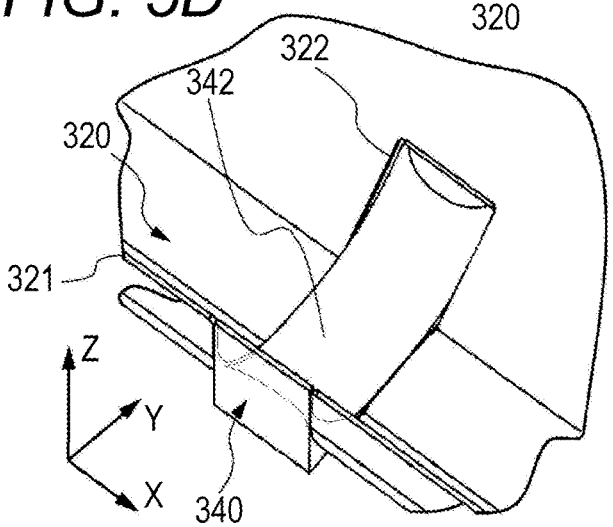
FIG. 5D is a perspective view of the projection member fitted in the guide.

FIG. 5C is a perspective view of the projection member 340 to be fitted in the outer guide 320, and FIG. 5D is a perspective view of the projection member 340 fitted in the outer guide 320. In FIG. 5D, the projection member 340 and the outer guide 320 are illustrated as if these are transparent. The projection member 340 is, for example, a soft resin rod, and both ends thereof in the longitudinal direction are steeply curved in the same direction, and the width in a direction (X axis direction in the drawing) perpendicular to both of the longitudinal direction and the curve direction is equal to the width of the slit 322 of the outer guide 320. As shown in FIG. 5A, in a state in which the projection member 340 is fitted in the slit 322 of the outer guide 320, substantially the entirety of the projection member 340 projects to the movement space of the sheet SH5 as compared with the outer guide 320. A surface 342 of the projection member 340 facing the movement space is positioned inside the curve of the projection member 340 and has a band shape smoothly curved along the conveyance direction, and forms a smooth J-shaped curved surface together with the range 324 from the upper end 323 to the slit 322 in the surface of the outer guide 320. Furthermore, as shown in FIG. 5D, the surface 342 of the projection member 340 facing the movement space of the sheet SH5 has an arcuate outline in the width direction (X axis direction) of the movement space. Since the surface facing the movement space for the sheet SH5 is smooth as described above, both the outer guide 320 and the projection member 340 hardly scratch the surface of the sheet SH5 due to friction.

Figure 6A:
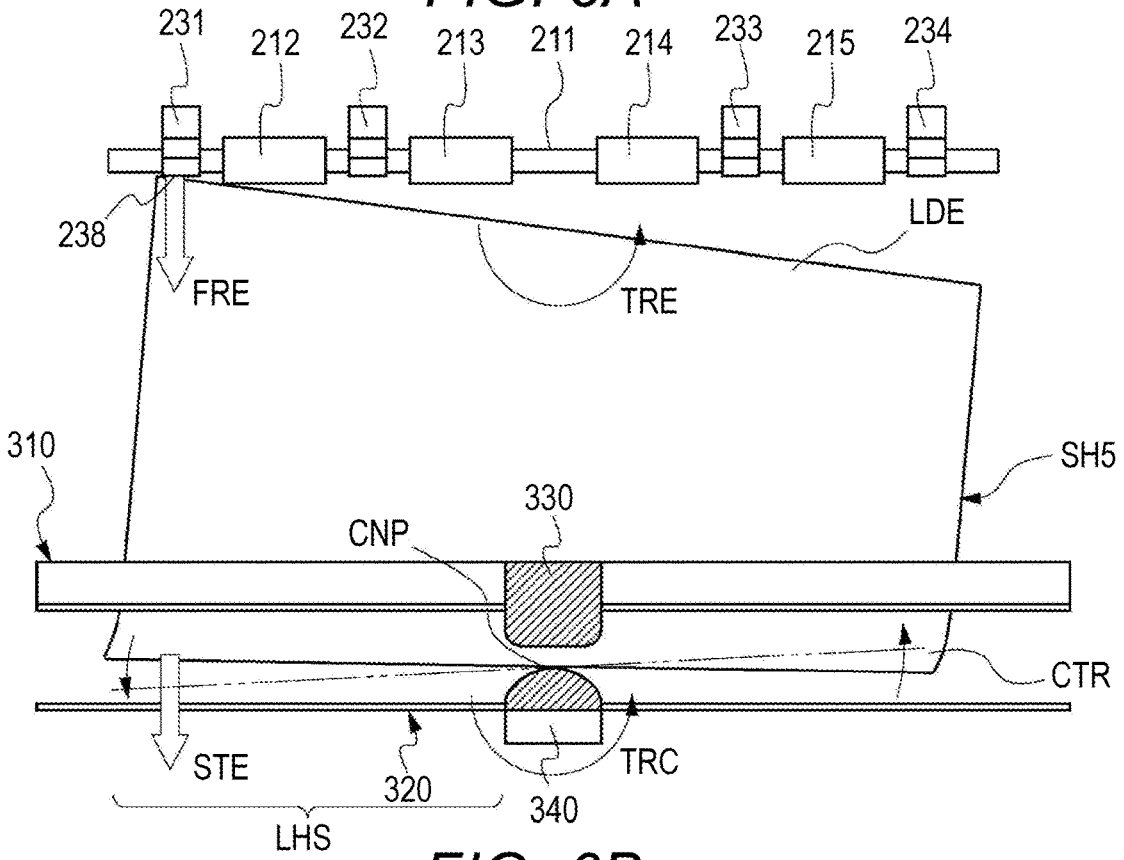
FIGS. 6A and 6B are each a schematic section view of a curved path and the vicinity of the terminal end thereof taken along a straight line VI-VI shown in FIG. 4.

FIG. 6A is a schematic section view of the curved path 300 and the vicinity of the terminal end thereof taken along a line VI-VI shown in FIG. 4, and in particular, shows a state in which a leading end LDE of the sheet SH5 moving through the curved path 300 has reached the positions of the swing members 231 to 234. When the sheet SH5 is skewed, the leading end LDE thereof abuts one of the swing members 231 to 234, for example, the claw portion 238 of the swing member 231 that is on the outside, ahead of the claw portions 238 of the other three swing members 232 to 234. Due to reaction force FRE received by the leading end LDE of the sheet SH5 from the claw portion 238, a moment TRE about a normal (the normal to the page surface in FIG. 6A) passing through the leading end LDE is generated in the sheet SH5. Meanwhile, in the range where the projection member 340 fitted in the outer guide 320 is positioned in the curved path 300, a component STE that presses a center portion CTR in the longitudinal direction of the sheet SH5 against the surface 342 of the projection member 340 is large in the stress caused in the sheet SH5 by the reaction force FRE. However, this component STE is acts greatly only in a region LHS positioned closer to the swing member 231 that the leading end LDE of the sheet SH5 first abuts compared with a portion CNP in contact with the projection member 340 in the center portion CTR of the sheet SH5. Therefore, a moment TRC about the advance direction of the portion CNP in contact with the projection member 340 (the normal to the sheet surface in FIG. 6A) is generated in the center portion CTR of the sheet SH5. Since the sheet SH5 is wider than the projection member 340, the center portion CTR thereof rotates about the portion CNP in contact with the projection member 340 and moves obliquely with respect to the width direction (left and right direction in FIG. 6A) of the movement space for the sheet SH5.

The projection member 340 opposes the projection member 330 fitted in the inner guide 310 with the movement space for the sheet SH5 therebetween. The interval between the projection members 330 and 340 is narrower than the interval between the guides 310 and 320 positioned further on the outside than the projection members 330 and 340 in the width direction of the movement space for the sheet SH5. Therefore, even when the center portion CTR of the sheet SH5 is accidentally lifted off the surface 342 of the projection member 340 while rotating about the contact portion CNP with the projection member 340 of the outer guide 320, the center portion CTR collides with the opposing projection member 330 and falls down. In this way, the center portion CTR of the sheet SH5 is reliably inclined with respect to the width direction.

Figure 6B:
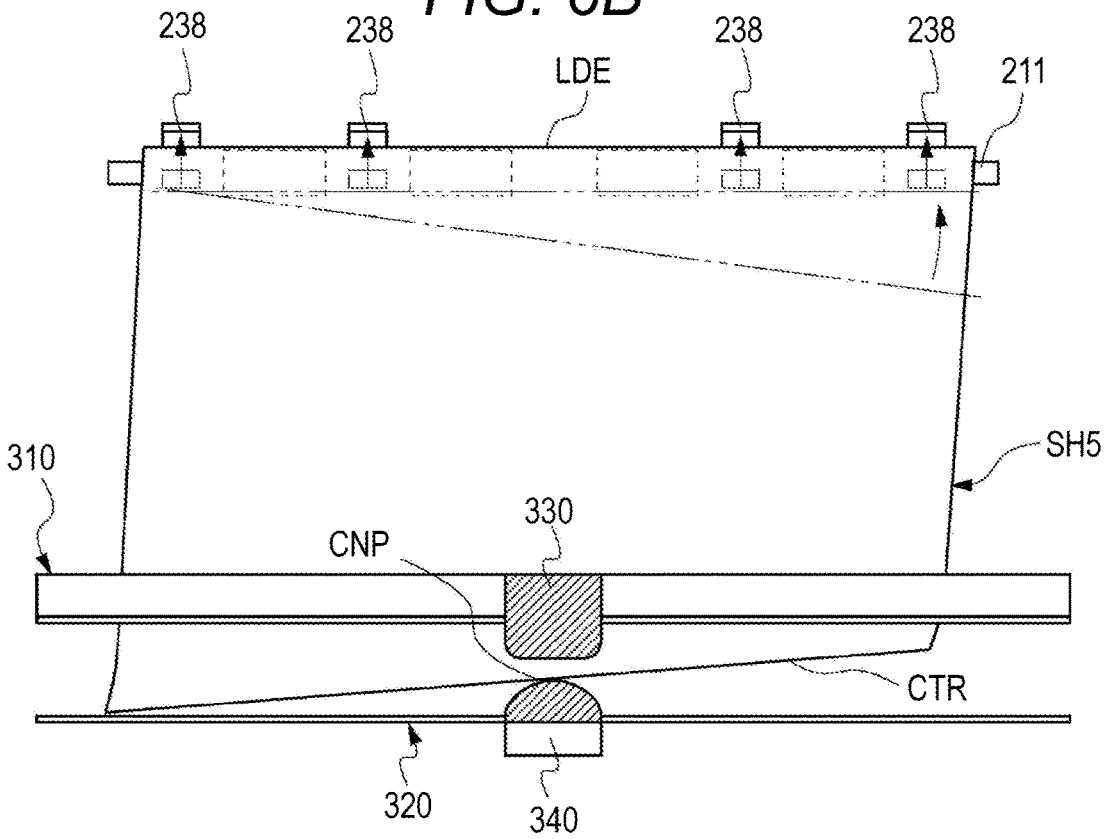

FIG. 6B is a schematic section view of the curved path 300 and the vicinity of the terminal end thereof taken along the line VI-VI shown in FIG. 4, and in particular, shows a state in which the center portion CTR of the sheet SH5 moving through the curved path 300 is inclined with respect to the width direction of the movement space. Since the center portion CTR is inclined in this manner in accordance with the reaction force FRE received by the leading end LDE of the sheet SH5 from the claw portion 238 of the swing member 231, even if the contact portion CNP receives strong frictional force from the projection member 340, the leading end LDE smoothly rotates to a position where the leading end LDE abuts all the claw portions 238 of the swing members 231 to 234 (a position to be parallel to the left and right direction in FIG. 6B) without being prevented by the frictional force. The skew is reliably removed from the sheet SH5 in this way, and thus the sheet SH5 can advance by pushing away the claw portions 238 of the swing members 231 to 234.

Advantages of Embodiment

In the sheet conveyance apparatus according to the above-described embodiment of the present invention, the outer guide 320 disposed along the curved path 300 includes the projection member 340 projecting to the movement space for the sheet SH5. This projection member 340 generates the moment TRC about the advance direction of the contact portion CNP with the projection member 340 at the center portion CTR of the sheet SH5 in accordance with the moment TRE generated as a result of leading end LDE of the sheet SH5 abutting the swing member 231 of the gate 230. Accordingly, even in the case where the sheet SH5 is strongly pressed against the outer guide 320 by the reaction force FR2 from the gate 230 as a result of the abutment of the leading end LDE in addition to by the force FR1 from the conveyance roller 481 that sends the sheet SH5 to the curved path 300, the sheet SH5 can rotate about the contact portion CNP with the projection member 340 by the same reaction force FR2. In this manner, this sheet conveyance apparatus maintains the reliability of the skew correction by the gate registration method high irrespective of the steepness of the curve of the curved path 300. As a result, this sheet conveyance apparatus can be further miniaturized.

Modification Embodiment (A) The image forming apparatus 100 shown in FIGS. 1A and 1B is an MFP. The sheet conveyance apparatus according to the embodiment of the present invention may be incorporated in a single-function image forming apparatus such as a printer, a copier, a facsimile machine, or the like. In addition, the printing function of the apparatus may be of an inkjet system instead of the electrophotographic system. The sheet conveyance apparatus according to the embodiment of the present invention can be incorporated in any system as long the system is a sheet processing system such as a finisher or an ADF.

(B) The elastic member 236 of the gate 230 shown in FIGS. 2A and 2B is a coil spring. The elastic member may be a spring of a different shape such as a leaf spring or a torsion spring, or an elastomer instead of the coil spring.

(C) When all the claw portions 238 of the swing members 231 to 234 of the gate 230 shown in FIG. 4 abut the leading end of the sheet SH5, the swing members 231 to 234 rotate about the shaft 211 to swing the claw portions 238 and thus allows the advance of the leading end of the sheet SH5. The movable member to be included in the gate may have a different structure as long as the movable member is disposed such that the sheet abuts the movable member in the movement space for the sheet and the movable member allows the advance of the leading end of the sheet by being pushed away by the leading end when the leading end of the sheet abuts the movable member. In particular, a plurality of different members need not abut the leading end of the sheet. For example, a mechanism in which a single plate member is disposed to lies. over the entire width of the movement space for the sheet, the inclination of the plate member to the conveyance direction of the sheet is variable, and the plate member is pushed down by the leading end of the sheet abutting the plate member may be employed.

(D) When all the claw portions 238 of the swing members 231 to 234 of the gate 230 shown in FIG. 4 abut the leading end of the sheet SH5, force of the conveyance rollers 12F, 13, and 481 received from the leading end is stronger than the restoring force of the elastic member 236, and thus the swing members 231 to 234 rotate in such a direction that the claw portions 238 are pushed away by the leading end of the sheet SH5. As a result, the timing at which the gate 230 allows the advance of the leading end of the sheet SH5 is before the loop is formed a stagnated portion of the sheet SH5, and thus there is no need to secure a space for forming a loop of the sheet on the upstream side of the skew correction portion 200.

In this manner, in the skew correction by the gate registration method, the size of the movement space for the sheet to be secured upstream of the gate can be reduced if the timing at which the gate allows the advance of the leading end of the sheet is before forming a loop in the stagnated portion. Therefore, the gate may be a mechanism in which, for example, the gate detects abutment of the leading end of the sheet on the movable member by a sensor and the movable member is retracted from the movement space for the sheet by an actuator such as a solenoid before forming a loop in the stagnated portion of the sheet instead of the mechanism in which the sheet moves the movable member such as the swing members 231 to 234.

(E) The projection member 340 fitted in the outer guide 320 shown in FIGS. 5A to 5D is positioned inside the both ends in the width direction of the sheet SH5 moving in the curved path 300, and the surface thereof projects to the movement space for the sheet SH5 compared with the surface of the outer guide 320 therearound. Due to this placement and shape of the projection member 340, as shown in FIG. 6A, when the leading end LDE of the skewed sheet SH5 abuts the swing member 231 that is one of the swing members 231 to 234, the reaction force FR2 from the swing member 231 generates the moment TRC about the contact portion CNP with the projection member 340 in the center portion CTR of the sheet SH5 and inclines the leading end LDE. As a result, the leading end LDE rotates smoothly to the position where the leading end LDE abuts all of the swing members 231 to 234.

Therefore, it suffices as long as the projection to be included on the surface of the outer guide 320 facing the movement space for the sheet SH5 has the following features. This projecting portion is positioned inside the both ends of the sheet SH5 in the width direction of the movement space for the sheet SH5 and projects to the movement space. Further, this projection comes into contact with the center portion CTR of the leading end LDE of the sheet SH5 in the longitudinal direction of the sheet SH5 when the leading end LDE abuts the gate 230, and generates the moment TRC about the advance direction of the contact portion CNP with the projection at the center portion CTR of the sheet SH5 in accordance with the moment TRE generated as a result of the leading end LDE abutting the gate 230. The member capable of forming the projection having these features is not limited to the above-described projection member 340, and various modifications as listed below are possible.

Figure 7A:
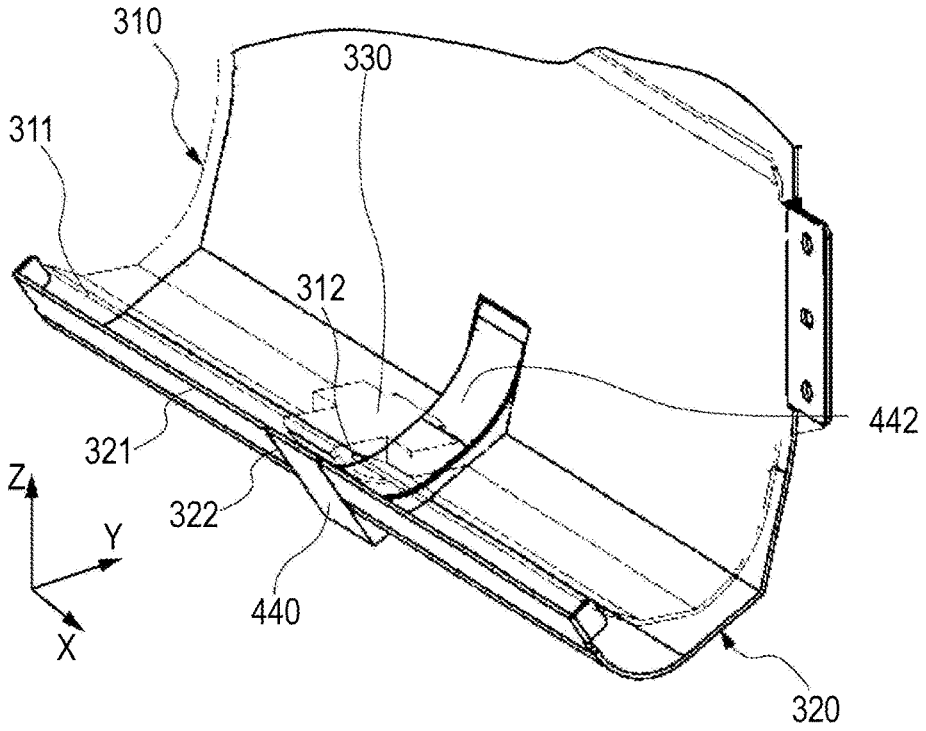
FIG. 7A is a perspective view of an outer guide in which a first modification embodiment of the projection member is fitted.

FIG. 7A is a perspective view of the outer guide 320 in which a first modification embodiment 440 of the projection member is fitted. In this figure, as in FIG. 5B, the inner guide 310 is illustrated as if the inner guide 310 is transparent. The projection member 440 according to the first modification embodiment differs from the projection member 340 shown in FIGS. 5A to 5D only in the following points. A surface 442 facing the movement space for the sheet is a flat surface parallel to both the width direction of the movement space and the advance direction of the portion of the sheet in contact with the surface 442. That is, unlike the projection member 340 shown in FIGS. 5A to 5D, the edge in the width direction of the projection member 440 is angular. An angular member like the projection member 440 may be utilized to form the projection of the outer guide 320 in the case where the member can give a negligible degree of damage to the surface of the sheet, in particular to the image thereon. The angular projection member 440 is easier to process than the arcuate projection member 340, and is thus advantageous for reducing the cost.

Figure 7B:
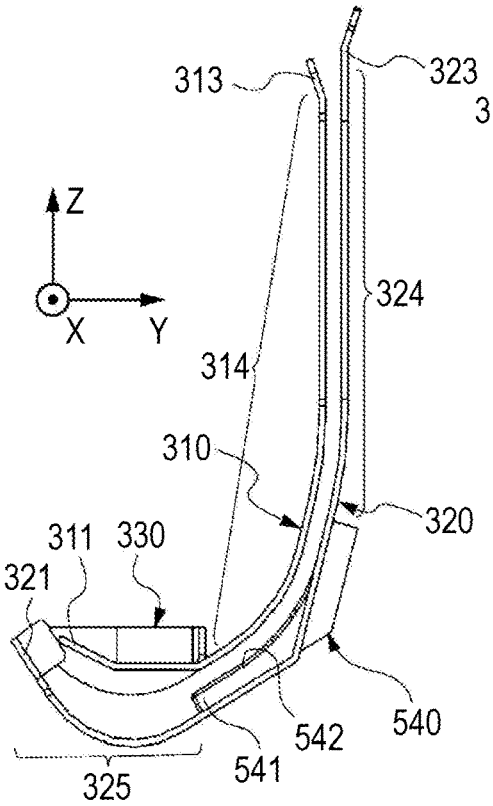
FIGS. 7B and 7C are respectively a front view and a perspective view of the outer guide in which a second modification embodiment of the projection member is fitted.
Figure 7C:
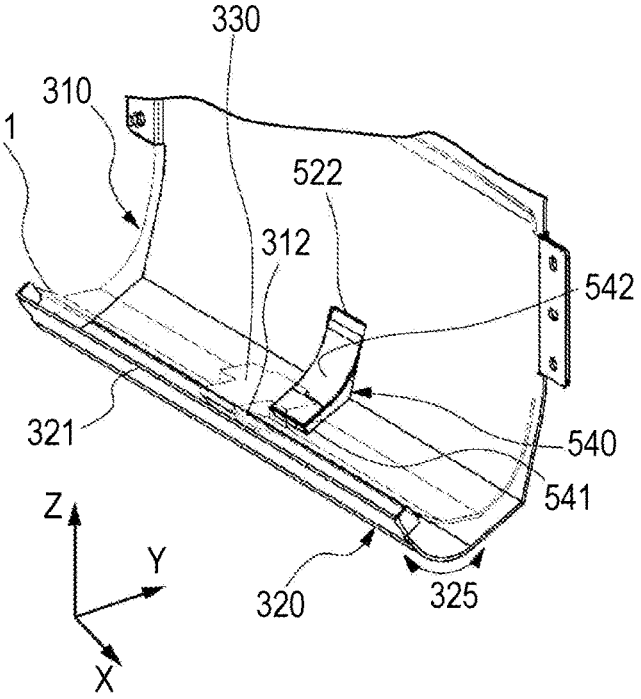

FIGS. 7B and 7C are respectively a front view and a perspective view of the outer guide 320 in which a second modification embodiment 540 of the projection member is fitted. In FIG. 7C, as in FIG. 7A, the inner guide 310 is illustrated as if the inner guide 310 is transparent. The projection member 540 according to the second modification embodiment differs from the projection member 440 of the first modification embodiment only in the following points. The size of the projection member 540 along the sheet conveyance direction is shorter than that of the projection member 440, and a downstream end 541 of the projection member 540 in the conveyance direction is positioned upstream of the downstream end 321 of the outer guide 320. Accordingly, the outer guide 320 includes a hole 522 of the same size as the projection member 540 in a center portion in the conveyance direction instead of the slit 322. A range 325 from the downstream end 321 to the hole 522 in the surface of the outer guide 320 is parallel to the width direction and is smoothly curved along the conveyance direction. A surface 542 of the projection member 540 according to the second modification embodiment facing the movement space for the sheet is shorter than that of the projection member 440 of the first modification embodiment in the conveyance direction, and therefore the contact portion at the center portion of the sheet in the conveyance direction is shortened. Even in the case where the projection member 540 is short as described above, the leading end of the sheet is smoothly rotatable to the position at which the leading end abuts all the swing members 231 to 234 of the skew correction portion 200 as long as the center portion of the sheet is surely inclined due to the moment about the contact portion. Meanwhile, since the downstream end 321 of the outer guide 320 is parallel to the width direction, the leading end of the sheet can be more stably guided to the skew correction portion 200.

Figure 8A:
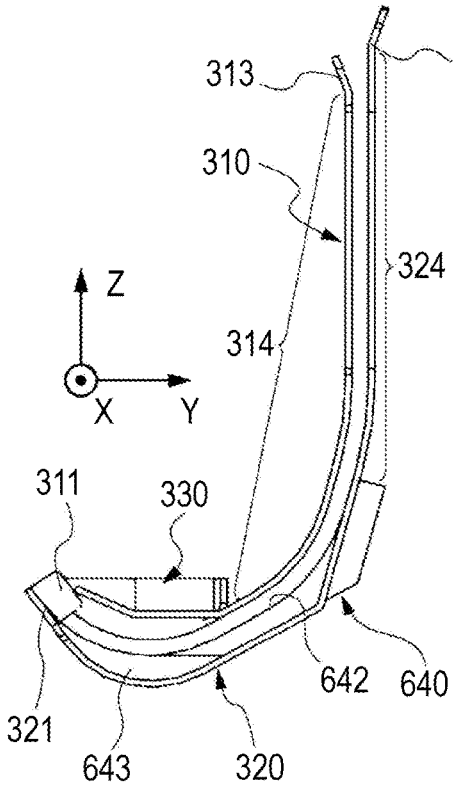
FIGS. 8A and 8B are respectively a front view and a perspective view of the outer guide in which a third modification embodiment of the projection member is fitted.
Figure 8B:
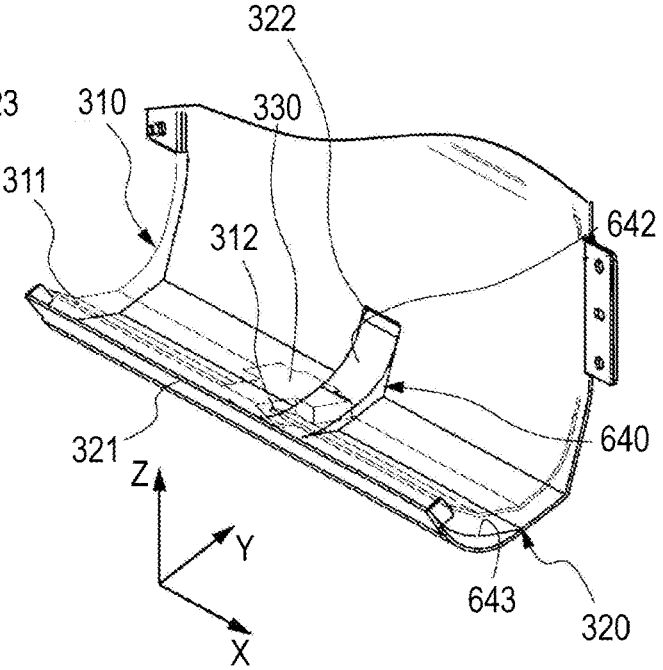

FIGS. 8A and 8B are respectively a front view and a perspective view of the outer guide 320 in which a third modification embodiment 640 of the projection member is fitted. In FIG. 8B, as in FIG. 5B, the inner guide 310 is drawn as if the inner guide 310 is transparent. The projection member 640 according to the third modification embodiment differs from the projection member 440 of the first modification embodiment only in the following points. An overhanging portion 643 projects from a downstream end portion 641 in the conveyance direction to the both side in the width direction and covers the entire width of the downstream end 321 of the outer guide 320. The surface of the overhanging portion 643 facing the movement space for the sheet is parallel to the width direction and is smoothly curved along the conveyance direction. Since a surface 642 of the projection member 640 according to the third modification embodiment facing the movement space for the sheet has the same shape and the same size as the surface 442 of the projection member 440 of the first modification embodiment, the effect of giving a moment about the contact portion to the center portion of the sheet and inclining the sheet is similar to that of the projection member 440 of the first modification embodiment. Meanwhile, the projection member 640 according to the third modification embodiment is more advantageous than the projection member 440 according to the first modification embodiment in that the overhanging portion 643 more stably guides the leading end of the sheet to the skew correction portion 200.

Figure 8C:
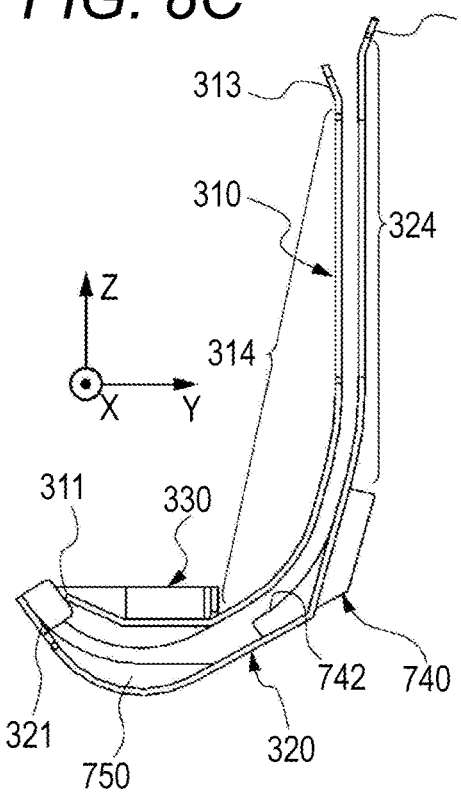
FIGS. 8C and 8D are respectively a front view and a perspective view of the outer guide in which a fourth modification embodiment of the projection member is fitted.
Figure 8D:
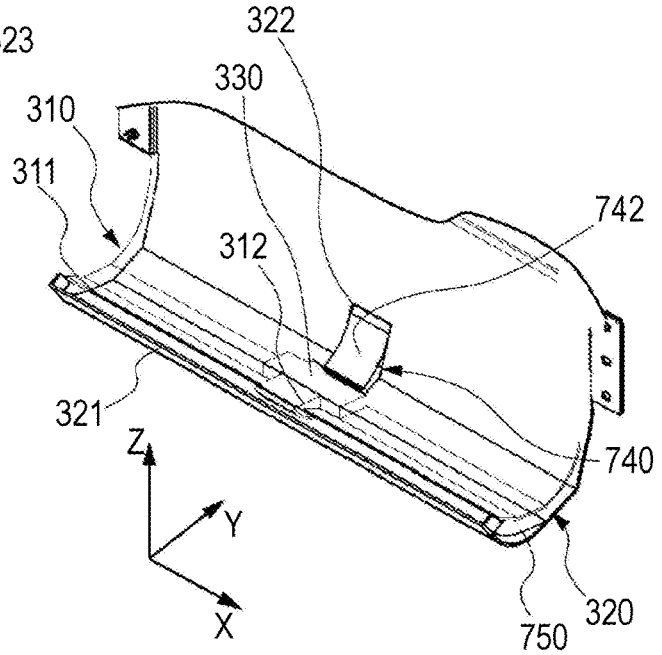

FIGS. 8C and 8D are respectively a front view and a perspective view of the outer guide 320 in which a fourth modification embodiment 740 of the projection member is fitted. In FIG. 8D, as in FIG. 8B, the inner guide 310 is drawn as if the inner guide 310 is transparent. The projection member 740 according to the fourth modification embodiment is a similar member to the projection member 540 according to the second modification embodiment as a single body, and is different from the projection member 540 according to the second modification embodiment only in that the projection member 740 is disposed in combination with a floor member 750. The floor member 750 covers the entire width of the downstream end 321 of the outer guide 320, and the surface facing the movement space for the sheet is parallel to the width direction and is curved smoothly along the conveyance direction. Since a surface 742 of the projection member 740 according to the fourth modification embodiment facing the movement space for the sheet has the same shape and the same size as the surface 542 of the projection member 540 of the second modification embodiment, the effect of giving a moment about the contact portion to the center portion of the sheet and inclining the sheet is similar to that of the projection member 540 of the second modification embodiment. Meanwhile, the projection member 740 according to the fourth modification embodiment is more advantageous than the projection member 540 according to the second modification embodiment in that the floor member 750 more stably guides the leading end of the sheet to the skew correction portion 200.

(F) The projection member 330 is fitted in the inner guide 310 shown in FIGS. 5A to 5D and opposes to the projection member 340 of the outer guide 320 with the movement space for the sheet therebetween. Since the interval between the projection members 330 and 340 is narrow, the center portion of the sheet reliably rotates about the contact portion of the outer guide 320 with the projection member 340, and is inclined with respect to the width direction. However, in the case where the center portion of the sheet is reliably inclined even if the projection member 330 of the inner guide 310 is not provided because, for example, the projection amount of the projection member 340 of the outer guide 320 is sufficiently large, the projection member 330 may be omitted from the inner guide 310.

(G) In the curved path 300 shown in FIG. 2A, the force FR1 that the sheet SH5 receives from the conveyance roller 481 positioned at the starting end of the curved path 300 and the reaction force FR2 that the sheet SH5 receives from the claw portions 238 of the swing members 231 to 234 only form an angle θ smaller than 90°. In this case, since the stress components ST1 and ST2 that press the sheet SH5 against the surface of the outer guide 320 are remarkably large in the same range RNG in the curved path 300, there is a high risk that the rotation of the leading end of the sheet SH5 is hindered by the frictional force from the outer guide 320 without the projection member 340. However, even if the curve of the curved path is not steep such that the force from the conveyance rollers and the reaction force from the claw portions 238 of the swing members 231 to 234 form an angle of 90° or more, a projection member similar to the projection member 340 may be disposed on a guide disposed outside the curve. Also in this case, the rotation of the leading end of the sheet in accordance with the abutment on the claw portions 238 is promoted by the center portion thereof being rotated and inclined about the contact portion with the projection member. As a result, the reliability of the skew correction portion 200 can be maintained high.

The present invention relates to a sheet conveyance technique in which a projection is provided on a guide disposed outside the curve of a curved path, and when the leading end of a sheet having passed through the curved path abuts the gate, the sheet is inclined by rotating the center portion of the sheet about a contact portion with the projection. Thus, the present invention is clearly industrially applicable.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet conveyance apparatus that conveys a sheet along a curved path shorter than the sheet and corrects skew of the sheet at a terminal end of the curved path, the sheet conveyance apparatus comprising:

a conveyance roller that is disposed at a starting end of the curved path and sends the sheet into the curved path;

a curved guide that is disposed outside a curve of the curved path and guides the sheet along the curved path, wherein the curved guide has a curved shape that is similar to a curved shape of the curved path, wherein the curved guide is configured to change a conveyance direction of the sheet by an angle greater than 90°; and a gate that is disposed at the terminal end of the curved path such that a leading end of the sheet abuts the gate, hinders advance of the leading end, generates, at the leading end, a first moment about an axis that is perpendicular to the plane of the sheet passing through the leading end, and allows advance of the leading end when the gate is pushed away by the leading end, wherein the curved guide includes a projection projecting into a movement space a sufficient distance to contact and deflect the leading end of the sheet on a surface facing the movement space, the projection being provided in a region further on an inside than both ends of the sheet in a width direction of the movement space, and when the leading end of the sheet abuts the gate, the projection abuts a center portion of the sheet in a longitudinal direction and generates a second moment about an axis parallel to the longitudinal direction of a portion of the sheet that has come into contact with the projection in accordance with the leading end abutting the gate, wherein the first and second moments correct the skew of the sheet.

2. The sheet conveyance apparatus according to claim 1, wherein an upstream end of the surface of the curved guide facing the movement space for the sheet in a conveyance direction of the sheet is parallel to a width direction of the movement space for the sheet, and a region from the upstream end of the curved guide to the projection is a smoothly curved surface.

3. The sheet conveyance apparatus according to claim 1, wherein a top of the projection is a flat surface parallel to a width direction of the movement space for the sheet and to the advance direction of the portion of the sheet that has come into contact with the projection.

4. The sheet conveyance apparatus according to claim 1, wherein the gate includes at least one movable member disposed on each side of a center of the terminal end of the curved path in a width direction of the movement space for the sheet, and the at least one movable member is disposed such that the leading end of the sheet abuts the at least one movable member, is supported so as to be swingable about the width direction, and allows the advance of the leading end by swinging by being pushed by the leading end when the leading end of the sheet abuts the at least one movable member.

5. The sheet conveyance apparatus according to claim 1, wherein an angle formed by a direction of force that the sheet receives from the conveyance roller and a direction of force that the leading end of the sheet receives from the gate is smaller than 90°.

6. An image forming apparatus comprising:

the sheet conveyance apparatus that conveys a sheet according to claim 1; and an image forming part that forms an image on a sheet conveyed by the sheet conveyance apparatus.

7. A sheet conveyance apparatus that conveys a sheet along a curved path shorter than the sheet and corrects skew of the sheet at a terminal end of the curved path, the sheet conveyance apparatus comprising:

a conveyance roller that is disposed at a starting end of the curved path and sends the sheet into the curved path;

a guide that is disposed outside a curve of the curved path and guides the sheet along the curved path, wherein the guide is configured to change a conveyance direction of the sheet by an angle greater than 90°; and a gate that is disposed at the terminal end of the curved path such that a leading end of the sheet abuts the gate, hinders advance of the leading end, generates, at the leading end, a first moment about an axis that is perpendicular to the sheet passing through the leading end, and allows advance of the leading end when the gate is pushed away by the leading end, wherein the guide includes a projection projecting toward into a movement space a sufficient distance to contact and deflect the leading end of the sheet on a surface facing the movement space, the projection being provided in a region further on an inside than both ends of the sheet in a width direction of the movement space, and when the leading end of the sheet abuts the gate, the projection abuts a center portion of the sheet in a longitudinal direction and generates a second moment about an axis parallel to the longitudinal direction of a portion of the sheet that has come into contact with the projection in accordance with the leading end abutting the gate;

wherein a timing at which the gate allows the advance of the leading end of the sheet is before causing a stagnated portion of the sheet to form a loop.

8. A sheet conveyance apparatus that conveys a sheet along a curved path shorter than the sheet and corrects skew of the sheet at a terminal end of the curved path, the sheet conveyance apparatus comprising:

a conveyance roller that is disposed at a starting end of the curved path and sends the sheet into the curved path;

a guide that is disposed outside a curve of the curved path and guides the sheet along the curved path, wherein the guide is configured to change a conveyance direction of the sheet by an angle greater than 90°; and a gate that is disposed at the terminal end of the curved path such that a leading end of the sheet abuts the gate, hinders advance of the leading end, generates, at the leading end, a first moment about an axis that is perpendicular to the sheet passing through the leading end, and allows advance of the leading end when the gate is pushed away by the leading end, wherein the guide includes a projection projecting toward into a movement space a sufficient distance to contact and deflect the leading end of foi the sheet on a surface facing the movement space, the projection being provided in a region further on an inside than both ends of the sheet in a width direction of the movement space, and when the leading end of the sheet abuts the gate, the projection abuts a center portion of the sheet in a longitudinal direction and generates a second moment about an axis parallel to the longitudinal direction of a portion of the sheet that has come into contact with the projection in accordance with the leading end abutting the gate;

wherein an outline of a top of the projection has an arc shape at least in a width direction of the movement space for the sheet.

9. An image forming apparatus comprising:

an image forming part that forms an image on a sheet;

a curved path that conveys a sheet toward the image forming part;

a pair of curved guides that is disposed on each side of the curved path and guides the sheet along the curved path, wherein the curved guide has a curved shape that is similar to a curved shape of the curved path, wherein the curved guide is configured to change a conveyance direction of the sheet by an angle greater than 90°;

a gate configured such that a leading end of the conveyed sheet in the curved path abuts and corrects skew of the sheet; and a projection provided in the curved path in a path center portion in a width direction of the curved path, such that a leading edge of a center portion of the sheet in a width direction of a sheet, the width direction being perpendicular to a sheet conveyance direction, contacts the projection and is deflected by the projection so as to support the curved sheet when the sheet abuts the gate.

* * * * *